US009418636B1

(12) United States Patent
Malluck et al.

(10) Patent No.: US 9,418,636 B1
(45) Date of Patent: Aug. 16, 2016

(54) WIND MUSICAL INSTRUMENT AUTOMATED PLAYBACK SYSTEM

(71) Applicants: John Andrew Malluck, Valencia, CA (US); Stephanie Lynn Malluck, Valencia, CA (US)

(72) Inventors: John Andrew Malluck, Valencia, CA (US); Stephanie Lynn Malluck, Valencia, CA (US)

( * ) Notice: Subject to any disclaimer, the term of this patent is extended or adjusted under 35 U.S.C. 154(b) by 3 days.

(21) Appl. No.: 14/461,443

(22) Filed: Aug. 18, 2014

Related U.S. Application Data

(60) Provisional application No. 61/867,573, filed on Aug. 19, 2013.

(51) Int. Cl.

| | |
|---|---|
| ***G10F 1/12*** | (2006.01) |
| *G10H 1/00* | (2006.01) |
| *G10H 3/00* | (2006.01) |
| *G10H 7/00* | (2006.01) |
| *G10H 5/00* | (2006.01) |

(52) U.S. Cl.
CPC .. *G10F 1/12* (2013.01); *G10H 1/00* (2013.01); *G10H 3/00* (2013.01); *G10H 5/00* (2013.01); *G10H 7/00* (2013.01)

(58) Field of Classification Search
CPC ..... G10H 1/00; G10H 3/00; G10H 5/00; G10H 7/00; G10F 1/12
USPC ..... 84/93, 678, 723
See application file for complete search history.

(56) References Cited

U.S. PATENT DOCUMENTS 147,759 A * 2/1874 Fowler ..... G10D 9/026 84/398
2,536,261 A * 1/1951 Caldwell, Jr. ..... H04R 1/086 181/242
3,543,629 A * 12/1970 Barcus ..... G10D 7/10 84/398
3,555,956 A * 1/1971 Martin ..... G10H 3/00 84/400
3,562,397 A * 2/1971 Uchiyama ..... G10H 1/0033 84/171
3,938,419 A * 2/1976 De Rosa ..... G10H 5/002 84/678
4,203,338 A * 5/1980 Vidas ..... G10D 7/10 84/445

(Continued)

FOREIGN PATENT DOCUMENTS

EP 1804236 B1 11/2008
EP 1585107 B1 5/2009

OTHER PUBLICATIONS

Beauchamp, J. "Analysis of Simultaneous Mouthpiece and Output Waveforms of Wind Instruments", AES Convention 66 (May 1980), Paper 1626 (C-3).

(Continued)

*Primary Examiner* — David Warren
*Assistant Examiner* — Christina Schreiber

(57) ABSTRACT

An automated playback system for a wind musical instrument which reproduces the musical performance of the wind instrument with high fidelity. The system comprises a sounding body, a piston, a signal-driven actuation means, a signal playback means and a drive signal. In one or more embodiments, the sounding body has a shape related to a wind musical instrument and has a sleeve opening which houses a piston; an electro-dynamic actuation means motivates a piston using a unique armature structure; a signal playback means provides a drive signal related to a measurement of the internal air column acoustic pressure of a wind instrument while played by a human player. Embodiments of the invention provide a convincing reproduction of a live musical performance and can be used in situations ordinarily requiring a human performer, offering a distinct advantage.

15 Claims, 4 Drawing Sheets

(56) References Cited

U.S. PATENT DOCUMENTS

| | | | | | |
|---|---|---|---|---|---|
| 4,515,060 | A * | 5/1985 | Ferron | G10D 9/00 | 84/380 R |
| 4,805,732 | A * | 2/1989 | Moritz | G10K 9/10 | 181/161 |
| 5,142,961 | A * | 9/1992 | Paroutaud | G10F 1/00 | 84/2 |
| 5,315,060 | A * | 5/1994 | Paroutaud | G10F 1/00 | 84/11 |
| 5,569,864 | A * | 10/1996 | Hamanaga | G10D 9/06 | 84/400 |
| 6,653,546 | B2 * | 11/2003 | Jameson | G10H 3/125 | 84/616 |
| 7,683,246 | B2 * | 3/2010 | Hashimoto | G10D 9/026 | 84/387 R |
| 7,723,605 | B2 * | 5/2010 | Gremo | G10H 1/344 | 84/615 |
| 7,858,871 | B2 * | 12/2010 | Fujii | G10D 9/026 | 84/600 |

OTHER PUBLICATIONS

Raes. W. "Korn." Archived May 2, 2013. Retrieved Oct. 19, 2014. [http://logosfoundation.org/instrum_gwr/korn.html]. Internet Wayback Machine. [https://web.archive.org/web/20130502032323/http://logosfoundation.org/instrum_gwr/korn.html].

Raes,W. "Expression control in automated musical instruments". Archived Oct. 5, 2013. Retrieved Oct. 19, 2014. [https://web.archive.org/web/20131005231739/http://logosfoundation.org/g_texts/expression-control.html] Internet Wayback machine. [http://logosfoundation.org/g_texts/expression-control.html].

Raes, W. "Asa: Automated alto saxophone". Archived Oct. 5, 2013. Retrieved Oct. 19, 2014. [http://logosfoundation.org/instrum_gwr/asa.html]. Internet Wayback Machine. [https://web.archive.org/web/20131005230802/http://logosfoundation.org/instrum_gwr/asa.html].

* cited by examiner

WIND MUSICAL INSTRUMENT AUTOMATED PLAYBACK SYSTEM

CROSS REFERENCE TO PROVISIONAL APPLICATION

This application claims the benefit of provisional application No. 61/867,573 filed Aug. 19, 2013 which is incorporated herein in its entirety.

BACKGROUND

Field of the Invention

The invention relates to a method to replay a live performance of a wind musical instrument with a system that does not require a human instrument player.

Prior Art Loudspeaker System

A traditional method of reproducing the sound of a live wind instrument performance is to record the performance using one or more microphones and to replay this recorded sound through loudspeakers.

This method has 2 drawbacks which limit how well the live performance is reproduced:

1. The three-dimensional (3D) sound field radiated from the loudspeaker does not closely resemble the 3D sound field produced by the wind instrument during the live performance. The directional aspects of the live performance are not captured or reproduced using the loudspeaker system.
2. The loudspeaker provides sound which does not closely resemble the sound produced by the live wind instrument. The sound recording is typically disrupted by the sound reflections in the room where the recording is made. The loudspeaker system also distorts the sound signal by not accurately reproducing the signal. The loudspeaker omits some portions of the performance timbre and introduces other noise and timbre unrelated to the musical performance.

For these reasons the loudspeaker playback methods have offered a playback experience which is lacking and not convincingly representative of the live performance.

Prior Art Automated Reproduction Systems (ARS)

Besides the loudspeaker method described above, automated reproduction systems (ARS) are present in the prior art. These systems rely on a drive system such as a compression driver or loudspeaker to excite sound inside a sounding body which is typically the body of a wind musical instrument. The drawback associated with prior art ARS is the systems produce sound that is even less realistic than the loudspeaker system described above.

Prior Art ARS Drive Mechanism

Prior art ARS have difficulty realistically reproducing the sound of a wind instrument performance because of limitations associated with their drive mechanisms.

The drive mechanism used in prior art ARS are typically one of the following:

a) Compression drivers, which comprise a voice coil armature attached to a piston membrane.

b) Loudspeakers, which comprise a voice coil armature attached to a piston cone.

Both drive mechanisms utilize moving surfaces that act as pistons to excite sound inside of a sounding body.

Inside the sounding body of the prior art ARS, the air column exerts a resistance to the motion of the drive piston that varies with frequency. The resistance of the air column is substantial at the resonance frequencies of the wind instrument air column.

To realistically excite the air column, the drive mechanism must deliver considerable force and velocity to the piston at the important resonant frequencies. Testing has revealed the voice coils used in prior art ARS do not have adequate force capability to accurately generate acoustic pressure within the air column. The instantaneous force delivered is not adequate to overcome the acoustical resistance of the air column. As a result, the waves generated inside the air column of the ARS are not an accurate duplication of a waveform measured during a live performance with a human player.

Prior Art ARS Sounding Body

Another limitation of the prior art ARS is related to the large piston utilized as part of the drive mechanism and the resulting shape of the sounding body. The large size of the piston results in a sounding body with shape and size adapted to couple with the piston. For this reason, the air column in the sounding body of the prior art ARS is not able to match the shape and size of a wind musical instrument, particularly in the area near the mouthpiece. For example, some ARS utilize an acoustic adapter or an added capillary tube to mate the large drive piston. The adaptor and capillary tube are mounted in place of the instrument mouthpiece. Since the shape and size of the air column do not match the wind instrument, the acoustical resonance characteristics are compromised. As a result, the sound produced by prior art ARS have a timbre that is not an accurate reproduction of a wind musical instrument performance.

Prior Art ARS Drive Signal

Prior art ARS have signal-driven actuators which produce an acoustic pressure in their sounding body according to a provided drive signal. Typically the drive signals are taken from either of the following measurements:

1) A measurement of the acoustic pressure generated in the mouth of a human player is collected while the instrument is played.
2) An external microphone measurement is performed while a wind instrument is played. This type of measurement is commonly performed in a recording studio or on a performance stage.

ARS drive signals taken from these measurements results in unrealistic sound reproduction because the measurements are loosely related to the pressure that is generated inside the wind instrument mouthpiece by a human performer. Examination of the microphone signals in a played wind instrument shows there is a measurable difference between the acoustic pressure waveform generated in the air column by the player and the acoustic pressure waveform measured elsewhere during instrument play.

ARS drive signals derived from the external microphone measurement result in inferior reproduction for two reasons:

1) As a musician introduces acoustic waves into a wind instrument, the air column timbers the waves as they travel and radiate from the instrument. For this reason, external microphones capture a timbered acoustic signal as a musician plays. Utilizing this timbered microphone signal as the drive signal of an ARS results in the ARS air column timbering an already timbered input signal and hence a less realistic playback of the live performance.

2) The sound propagating from a wind musical instrument radiates and reflects inside of a recording room as a musician plays. The reflected sound is recorded by the external microphone and contaminates the recorded signal. ARS which utilize a recording from an external microphone suffer a degradation in quality because of the room reverberation present in the drive signal.

DESCRIPTION OF THE INVENTION

The invention described in this section is an automated wind musical instrument playback system that is capable of producing a high fidelity sound field closely matching the sound produced by a live wind instrument performance.

Sounding Body

Embodiments of the invention have a sounding body with an internal air column. The air column is bounded generally by the internal surface of the sounding body. The sounding body has a shape and size that causes the internal air column to have acoustic resonance frequencies matching the internal air column resonance frequencies of a wind musical instrument. This allows the sounding body to produce timbered sound which accurately matches the sound of a wind musical instrument during play.

The sounding body for an embodiment may be a wind musical instrument (including mouthpiece). This configuration is advantageous because the resonance characteristics of a wind musical instrument are similar to the resonance characteristics of the wind musical instrument during human play. It should be understood, however that many acoustically analagous sounding bodies are possible which have acoustic resonances related to a played wind instrument but may not share the exact geometry of the wind musical instrument.

Some embodiments of the invention may have a sounding body with size and shape that is either matched or sized closely to the internal air column of a wind musical instrument. This includes a matched or close relationship with the mouthpiece portion of the wind instrument air column.

Any wind instrument may be used for the sounding body. For example a brass instrument such as a trumpet, bugle, cornet, clarino, flugelhorn, mellophone, French horn, alto horn, trombone, baritone horn, tuba or a woodwind instrument such as a flute, clarinet, saxophone, bassoon, may be used.

Since the sounding body seeks to match the at-play air column resonance conditions of the musical instrument, the shape, size and temperature of the sounding body may be designed to account for the at-play acoustic properties of the air column of the selected wind instrument.

During play, the internal air column of a wind musical instrument will adopt unique acoustic properties compared to the instrument that is not being played. During play, the musician inserts air from his or her body having a temperature that is different than the temperature of the air column at rest. Additionally the musician holds the instrument in his or her hands which also warms the instrument and air column compared to the instrument at rest.

Since the speed of sound is dependent on the air temperature and fluid flow speed, the size of the sounding body may be designed to account for these changes. For example, the sounding body can be designed with slightly longer tubular length to account for portions of the air column that are typically warmed above room temperature, or portions of the air column having significant fluid flow speed during play.

The sounding body could be warmed using a means of heating to reproduce the air column temperature as played. For example the sounding body and air column may be heated with a resistive type of heating elements powered by electricity. Thus the electrically powered resistive type heating elements constitutes a means for heating.

The sounding body may be constructed of materials and features that are related to the wind instrument of interest in order to allow the sounding body to produce similar vibration characteristics, which in turn allow a radiated sound field similar to the wind instrument of interest.

Piston

The invention has a piston with a surface in fluid communication with the air column of the sounding body. The piston is free to translate and is capable of generating a fluctuating acoustic pressure within the air column. The piston is constructed of a rigid or semi rigid material that sufficiently propagates fluctuating air pressure. Appropriate materials for the piston can include aluminum, steel, carbon fiber reinforced composite, fiberglass reinforced composite, Polytetrafluoroethylene (PTFE), or resin reinforced paper.

A major consideration for the piston is that it must be lightweight enough to enable high fidelity sound production. Since the piston is forced into motion, the mass of the piston produces an inertial force which opposes the force provided by the actuation means. Thus a more massive piston requires an actuation means with a larger force capability to achieve adequate piston velocity.

The piston may have any size or cross section shape so as long as the surface interfacing the air column is sufficient to generate the desired acoustic pressure. A piston with a round cross section is desirable because the piston is easily fashioned with narrow size tolerances.

For some embodiments the piston might also be the diaphragm of a compression driver or the cone of a loudspeaker.

Sleeve Opening

Since the piston delivers air pressure to the air column of the sounding body, it is advantageous for some embodiements to utilize a sleeve opening integrated with the sounding body or integrated into the sounding body itself. The sleeve opening provides a space for the piston to reside and prevents the leakage of acoustic air pressure at the interface between the piston and the sounding body. If a sleeve opening is not utilized, the acoustic pressure may leak from the air column of the sounding body to the outside air in the space between the piston and the sounding body.

A sleeve opening has a sleeve inner surface with a cross section that is related to the piston cross section. The sleeve opening can be closely sized to the piston to serve as a bearing surface, which mechanically guides the piston. The sleeve opening can also be slightly oversized compared to the piston to avoid direct material contact, but while still ensuring minimal acoustic leakage. A clearance distance less than 0.5 mm is appropriate to ensure adequate acoustic sealing. The latter is advantageous in that eliminating the contact reduces friction and heat build-up due to piston motion. In cases where the sleeve opening is oversized compared to the piston, flexures may be attached to the piston or actuator parts to ensure linear translation which prevents contact between the piston and the piston sleeve.

Means of Actuation

The piston is coupled to a signal-driven actuation means, which provides motion to the piston. The signal-driven actuation means can be any method to propel the piston as long as the motion is related to a provided drive signal. The signal-driven actuation means must be able to deliver the motion in manner such that a fluctuating pressure can be generated inside the sounding body.

The signal-driven actuation means may be an electro-dynamic actuator, which utilizes electricity to propel the piston. The electo-dynamic actuator has an electrical coil type of propulsion which is well known in the art and is commonly used to propel loudspeaker cones and vibration test shakers. The electro-dynamic actuator has a magnetic structure with magnetic north and south poles separated by a gap. The gap is filled with a pipe-shaped armature structure having an attached electrical coil of wire which is capable of passing electrical current. When electrical current is supplied to the coil a mechanical force is generated which causes movement of the armature and attached piston The armature of the electro-dynamic actuator is a structure which delivers force and motion to the piston. Some embodiements of the invention may utilize a unique armature having a pipe-shaped portion and also a ram portion. The pipe-shaped portion has the attached electrical coil (windings), whereas the ram portion serves to structurally join the pipe-shaped portion with the piston. Use of the ram portion in the armature allows for a larger voice coil to be used and to structurally join the large diameter pipe-shaped portion with a relatively smaller piston. This arrangement is advantageous as the larger diameter voice coil portion can deliver instantaneous force which generates an accurate wave form within the internal air column.

If an electro-dynamic actuator is used, a major consideration is the internal resonance of the armature structure. At the internal resonance frequency, the voice coil assembly is not able to deliver full force to the piston and the force delivered has unstable phase characteristics. For this reason it is best to design an armature structure with a first structural resonance frequency well above the important frequency range for the selected wind musical instrument. For example, a majority of the timbre for a trumpet occurs in the 50-4000 Hz frequency range. Selection and design of an electro-dynamic actuator armature with a first resonance above this range will result in more realistic playback characteristics. It is advantageous to build an armature structure with stiff and lightweight material to enable a first structural resonance frequency as high as possible.

Signal Means

A signal means provides a drive signal to the signal-driven actuation means when it is invoked to do so. The signal means can be any feasible method to replay a signal. Many signal storage and playback systems are used throughout the recording industry and could be used as the signal means. For example, the signal means could be a computerized storage and sound delivery system, a digital binloop, a DVD player, or a CD player.

Drive Signal

The drive signal is predetermined and is based on a pre-measured internal air column acoustic pressure (IACAP) measurement of a wind musical instrument, which is collected during play by a human player.

The following process is employed to measure the wind instrument IACAP as it is played by a human player:

A. Provide a wind musical instrument having an internal microphone. The microphone is arranged to provide a measurement of the wind instrument IACAP.

B. Playing the wind musical instrument while simultaneously measuring the time varying signal provided by the microphone.

C. Depositing the measurement (or a modified signal related to the measurement) onto the signal storage and playback means of a wind musical instrument automated playback system.

For recording, it is advantageous for the wind musical instrument to have the microphone placed as close as possible to the area where the player inserts acoustic pressure to the wind musical instrument. Measurements of the IACAP were performed in several areas of the air column. Testing shows the mouthpiece measurements produce the most accurate and realistic playback.

The microphone may require calibration according to commonly available calibration procedures. It is advantageous to have a calibrated measurement of IACAP so the automated playback system can verifiably produce a duplicate acoustic pressure.

The drive signal provided to the means of actuation is related to the pre-recorded IACAP signal. The drive signal is determined from the wind instrument IACAP in any of the following ways, though the reader should understand that other means of deriving and manipulating the pre-recorded sound pressure signal may be possible to arrive at the drive signal:

A. The drive signal may be an augmented or attenuated version of the wind instrument IACAP signal. For example, the prerecorded microphone signal can be provided to an amplifier which augments the signal making it appropriate to drive the means of actuation.

B. The drive signal may be a filtered version of the wind instrument IACAP such that certain frequency ranges are augmented or attenuated.

C. The drive signal may be a distorted version of the wind instrument internal air column acoustic pressure, which adds various effects to the wind instrument IACAP measurement.

The drive signal may be stored on a signal storage and playback unit until the unit is invoked to provide the drive signal to the means of actuation. An amplifier, filter array may be utilized to modify the drive signal as it is passed from the signal storage and playback unit to the means of actuation.

Operation

The invention operates by the signal means providing the drive signal to the signal-driven actuation means, which in turn moves the piston in a fashion to produce an acoustic pressure inside the sounding body. The acoustic pressure reverberates inside the sounding body and propagates as sound exterior to the sounding body. The sound produced is a high fidelity replay of the wind instrument because:

1) The drive signal is derived from the measured acoustic pressure of the wind musical instrument, which in turn generates internal acoustic pressure within the sounding body which closely matches the measured IACAP from the instrument under play.

2) The sounding body has acoustic resonances matching the selected wind instrument as it is being played and therefore timbres and reinforces the sound in a fashion matched to the original wind instrument.

3) The piston is sized to most effectively act upon the acoustical impedance of the air column and without modification being needed to couple with the sounding body.
4) The large voice coil delivers ample velocity to the piston so that an accurate wave form can be produced.

Closed Loop Control

To enable the highest possible fidelity, embodiments may also feature closed loop control for the piston actuation. To enable closed loop control the embodiment would utilize a microphone installed in the sounding body such that it provides a measurement of the IACAP. The measurement is conveyed to a closed loop controller which compares the measurement to the predetermined drive signal provided by the signal means and makes compensation to the drive signal. The makeup and operation of a closed loop controller is well known in the prior art. The provided compensation improves the accuracy of the pressure created in the sounding body.

The closed loop controller is a compensation means which receives the IACAP measurement to compensate the drive signal.

Closed loop control is especially useful for embodiments which have a time varying playback condition which cannot be accounted for on a predetermined basis. For example, if heat buildup changes the frequency response of the actuation means, closed loop control can be utilized to correct for this time varying phenomenon.

Closed loop control of the piston actuator requires a microphone to be placed in fluid communication of the internal air column at a location that is analogous to the microphone location used when recording the live wind instrument. The microphone in the sounding body provides a signal that reflects the real-time acoustic pressure that is being produced inside the sounding body and delivers the signal to a controller. The controller compares the pressure signal to the desired drive signal and makes continuous real time adjustments to more closely match the pressure to the desired drive signal.

Embodiments using close loop control can benefit from an arrangement where the microphone is placed within one eighth wavelength of the piston over the applicable frequency range of the wind instrument. This spacing minimizes the phase lag between the measurement and the drive signal.

DRAWINGS

Four drawings are presented to better describe the invention and an embodiment thereof.

REFERENCE NUMERALS

The following items are described with corresponding numerals on the drawings.

| | |
|---|---|
| 101 | bugle |
| 102 | mouthpiece |
| 103 | bugle drive assembly |
| 104 | amplified line |
| 105 | amplifier |

-continued

| | |
|---|---|
| 106 | single track storage and playback unit |
| 107 | signal line |
| 108 | bugle main tuning slide |
| 109 | bugle receiver |
| 201 | piston adapter |
| 202 | piston |
| 203 | ram portion |
| 204 | electrical coil |
| 205 | housing structure |
| 206 | flexure |
| 207 | magnetic structure |
| 208 | air column |
| 209 | pipe-shaped portion |
| 210 | transmitting surface |
| 211 | sleeve opening |
| 301 | probe tube |
| 302 | microphone assembly |
| 303 | signal connector |
| 401 | single track recorder |
| 403 | probe tube microphone |
| 405 | microphone line |
| 406 | microphone signal line |
| 407 | human player |
| 408 | microphone signal conditioner |

DETAILED DESCRIPTION

Embodiments

The invention will be understood more fully by describing the following embodiment.

Embodiment 1

The first embodiment is an automated playback system for a bugle musical wind instrument.

Figure 1:
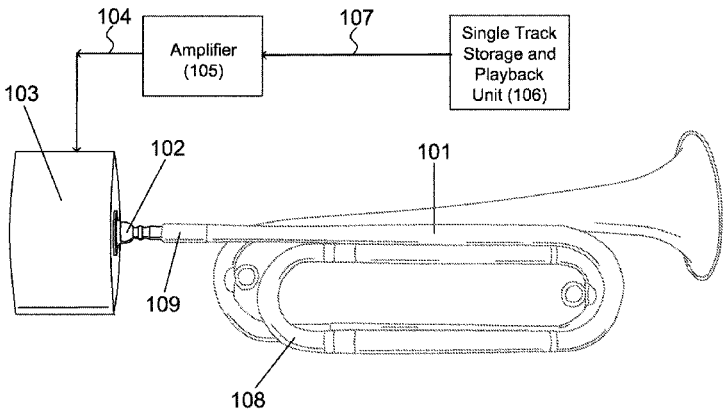
FIG. 1 shows an automated playback system for a bugle wind musical instrument.

FIG. 1 shows the general arrangement of the first embodiment. The playback system has a sounding body that is comprised of a bugle 101, and a mouthpiece 102 which is inserted into the bugle receiver 109. The makeup of the bugle and mouthpiece is customary and well known in the art. The sounding body is selected because it shares the vibro-acoustic resonances of the bugle, whose sound is desired for reproduction. The bugle main tuning slide 108 has a position that is slightly extended compared to the corresponding in-tune instrument which would be played in a live performance. The mouthpiece is attached to a bugle drive assembly 103.

A drive signal is provided to the bugle drive assembly by a signal means having a single track storage and playback unit 106, a signal line 107, an amplifier 105 and an amplified line 104. The single track storage and playback unit contains a predetermined signal and provides the predetermined signal to the amplifier by way of the signal line. The amplifier augments the predetermined signal and provides an amplified signal to the driver by way of the amplified line. The amplified signal is the drive signal required to drive the bugle driver assembly.

The lines used in this embodiment are electrical cables which may have multiple electrical conduits required to convey the needed signal. For example the drive line may have separate ground and signal conduits, which are required to carry the signal.

Figure 2:
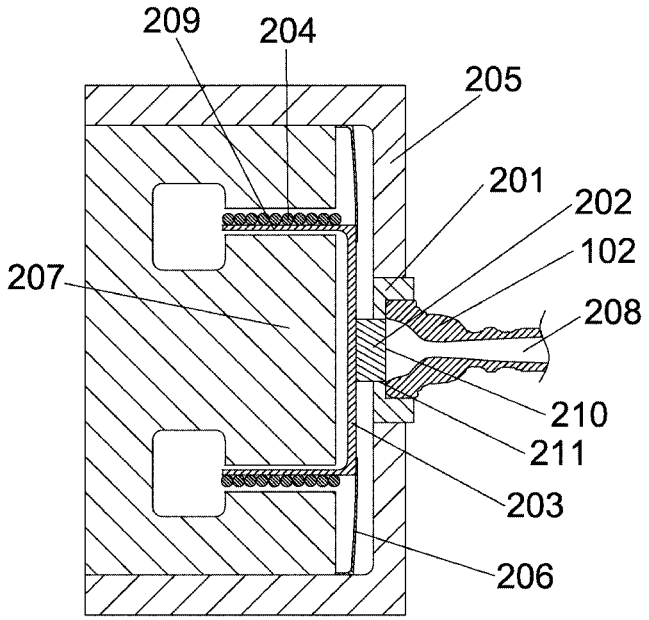
FIG. 2 is a section view of the bugle drive assembly and mouthpiece portion of the playback system.

FIG. 2 shows a cross section of the bugle drive assembly and the mouthpiece. The bugle drive assembly is roughly axisymmetric about a central axis. The bugle drive assembly has a piston adapter 201, which is attached to the mouthpiece 102, so that its bore is aligned with the mouthpiece opening. With this arrangement the piston adapter forms a portion of the sounding body which serves as a boundary for the internal air column and seals the acoustic pressure.

In FIG. 2, a piston 202, is nested (or resident) within the sleeve opening 211 of the piston adapter and has a transmitting surface 210 that is in fluid communication with the air column 208. The sleeve opening is oversized to allow piston travel along the assembly central axis without friction. The piston can be made from any rigid or semi-rigid material.

In FIG. 2, the piston is attached to an armature structure, which extends into the gap of the magnetic structure 207. The armature structure comprises a pipe-shaped portion 209, which has an electrical coil 204, and a ram portion 203. The ram portion serves to structurally join the pipe-shaped portion with the piston. The ram portion shown in FIG. 2 is arranged to run orthogonally through the central axis, though other arrangements for the ram portion could be used. For example a ram portion could be configured with an angled taper between the pipe-shaped portion and the piston.

In FIG. 2, the magnetic structure has magnetic north and sound poles on the opposing sides of the gap and hence the gap has magnetic flux traveling across. The pipe-shaped portion has the electrical coil attached to it in the gap region. The electric coil is interfaced with the amplified line and conveys the electrical current provided by the amplified line. Using this arrangement, the electrical coil produces a motivating force along the central axis causing the armature and piston to be driven when the amplified line delivers a current. When the amplified line delivers alternating current the electrical coil delivers alternating motion to the piston and hence the piston produces fluctuating acoustic pressure in the sounding body air column.

In FIG. 2, the armature structure is supported by flexures 206, which are thin structural members allowing motion along the central axis and preventing motion in other directions. The flexures are attached to the armature structure and to the housing structure 205. The housing structure is attached to the magnetic structure, flexures and piston adapter to maintain position and alignment.

The predetermined signal delivered by the single track storage and playback unit is developed from a signal taken from the microphone measurement of the IACAP of a bugle as it is played by a human. The microphone measurement is performed using a probe tube microphone, which is known in the prior art.

Figure 3:
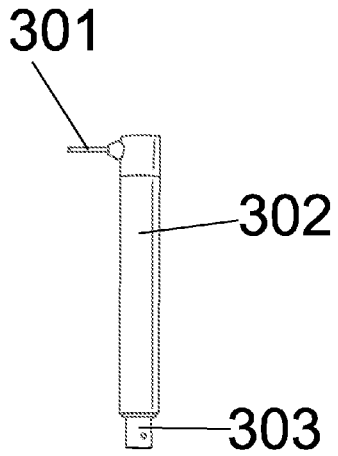
Figure 3 (Prior Art)
FIG. 3 shows a prior art probe tube microphone.

The probe tube microphone is shown in FIG. 3. The 40SC probe tube microphone manufactured by G.R.A.S. Sound & Vibration A/S is an example of a suitable probe tube microphone. The probe tube microphone has a probe tube 301, a microphone assembly 302, and a signal connector, 303. The probe tube is a metallic tube which allows the transit of acoustic pressure into the microphone. The microphone assembly has a membrane which converts the acoustic pressure into an electrical signal. The microphone assembly provides a low level microphone signal to the signal connector which can interface with a microphone cable.

Figure 4:
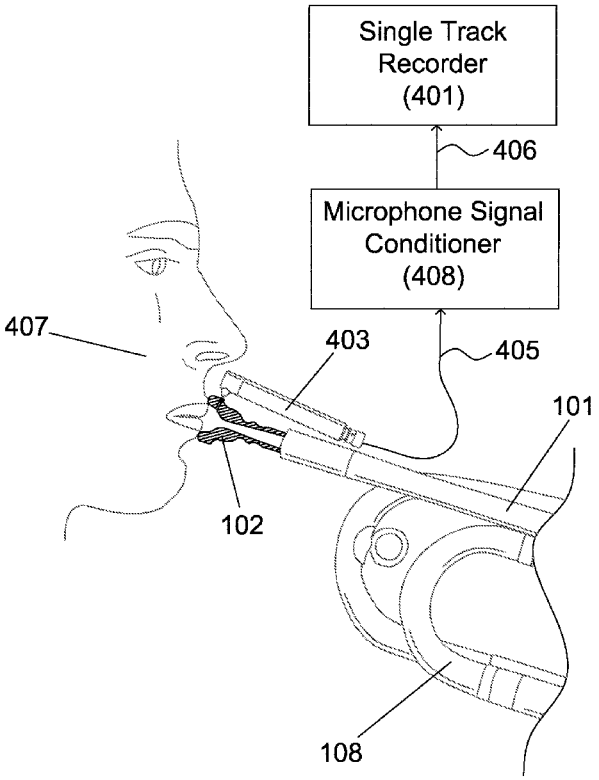
FIG. 4 shows an arrangement used to record the IACAP of a bugle during play by a human player.

FIG. 4 shows the arrangement utilized to perform measurement of the IACAP of the bugle. The bugle 101 has the same shape and size as the bugle used for the sounding body except the tuning slide 108 is pushed in slightly. The mouthpiece 102, shown in cross section in FIG. 4, is provided with a small hole that is just large enough to allow insertion of the probe tube microphone 403, as shown. While measuring acoustic pressure, the microphone provides a low level microphone signal to the microphone signal conditioner 408 through microphone line 405. An example of a microphone signal conditioner that is appropriate is the G.R.A.S. 12AL signal conditioner. The microphone signal conditioner converts the low level microphone signal into a voltage signal which is provided to the single track recorder 401 through microphone signal line 406. The signal is recorded on the single track recorder as a human player 407 plays a musical passage on the mouthpiece and the bugle.

For the first embodiment the same bugle is used for the sounding body and for the collection of the IACAP during the measurement process. This is convenient but is not strictly required for accurate performance reproduction. What is most important is that the sounding body shares the similar acoustical resonance frequencies as the instrument used during the collection of the IACAP.

It is noted that obtaining a measurement of the IACAP can require special features in order to execute a satisfactory measurement. During play a musician can introduce moisture into the probe tube microphone, which blocks the probe tube and can affect the electronic functioning of the microphone. If moisture is a problem, a very thin membrane can be attached to the inner surface (bore) of the mouthpiece in the area where the probe tube penetrates. The membrane is sealed to the mouthpiece inner surface in a perimeter surrounding the microphone penetration thereby sealing moisture out. The membrane will transmit acoustic pressure with only small reduction to high frequency sound and eliminates the propagation of moisture into the probe tube microphone.

While this embodiment utilizes a probe tube microphone, it is also possible for other types of microphones to be utilized to capture the internal air column acoustic pressure. Other small, microphones with high acoustical impedance may be utilized and should not appreciably alter the play of the instrument during the live performance.

After the microphone measurement has been performed, the recorded signal is taken from the single track recorder and is manipulated using a separate equalization unit to create the predetermined signal that is deposited on the single track storage and play back unit. Equalization of the recorded microphone measurement signal is required because the probe tube microphone slightly attenuates high frequencies. The signal provided by this microphone must be augmented in the high frequency range to reflect the actual pressure that was resident in the bugle mouthpiece during play. The signal is also equalized to account for the frequency response of the amplifier and the electro-dynamic actuator. The predetermined signal is taken as the result of the microphone signal being operated on by these equalization steps. When the predetermined signal is complete it is deposited onto the single track storage and playback unit.

In the first embodiment, the predetermined signal is based on an equalized version of the microphone measurement; though it is noted the microphone measurement could also be filtered or distorted to create the predetermined signal that is eventually made resident in the single track storage and playback system.

Embodiment 1 Operation

The first embodiment is operated by invoking the single track storage and playback unit to provide the predetermined signal. The signal is conveyed into the amplifier and an amplified signal is provided to the bugle drive assembly. The bugle drive assembly causes a fluctuating motion of the piston, which in turn produces an acoustic pressure inside the mouthpiece and air column. The acoustic pressure resonates and reinforces inside the air column and a timbered sound is propagated from the bugle. If the predetermined signal is properly equalized, the pressure generated in the mouthpiece will closely resemble the actual pressure that occurs when a human plays a musical passage on the bugle. Since the sounding body shares the acoustic resonances with the played bugle, the sound contains all the timbered qualities of the live performance and the musical passage is reproduced by the playback system in high fidelity.

Alternative Embodiments

Various modifications and changes are also contemplated and may be utilized to optimize the playback system. The following paragraphs describe potential alternate embodiments.

Embodiments of the invention utilizing closed loop control for the signal-driven actuation means comprise a microphone and a closed loop controller. The microphone provides a measurement of the IACAP to the closed loop controller during playback. The microphone used for these embodiments might be identical to the mouthpiece and probe tube microphone arrangement shown in FIG. 4.

In some embodiments, electrical current flow in the armature and friction in the piston have generated problematic heat. Heat in the armature can lead to coil overheating and physical damage of the armature structure and electrical coil. Heat buildup in the piston can lead to growth of the piston so friction forces increase thereby slowing the piston and causing additional heat generation.

To overcome the heat buildup a forced air system is contemplated which delivers cool air to both the armature and the piston. The flow could be routed on a pathway through the magnetic structure or supplied external to the electrical coil or possibly a combination of both. It is also contemplated that the piston could feature a hydrostatic bearing between the piston and the piston sleeve whereby the piston is suspended on a pillow of pressurized air. This will eliminate much of the surface to surface contact between the piston sleeve and the piston and will directly provide a cooling source.

It is envisioned that a variety of sounding body designs will be utilized, all having acoustic resonances similar to the selected wind instrument, but possibly with additional resonances that contribute a desired unique timbre. In this regard, the sounding body can be creatively designed to produce new timbres which expand the musical palate available for playback.

ADVANTAGES

Embodiments provide a high quality reproduction of the sound from a wind musical instrument. The sound produced closely matches the original performance in terms of timber and also in terms of its spatial characteristics.

The convincing reproduction of a live wind instrument performance is an advantageous aspect which will result in embodiments being used in place of a musician. Hiring a musician to play at certain occasions could be eliminated by using an embodiment, which saves the considerable cost of hiring the musician.

Using various embodiments in place of musicians is also advantageous because the embodiments achieve musical playback beyond the capability of a human musician. Embodiments can play continuously without stop and with a complete range of dynamic volume levels. Furthermore, the embodiments can flawlessly reproduce even the most challenging musical passages repeatedly without errors. This capability is beyond the capability of musicians, who need periodic rest periods.

Embodiments are also advantageous because they offer a means to remotely convey a musical performance never realized in the past. It is envisioned that embodiments will be utilized in an arrangement where a live performance is recorded and the recorded signal is sent to a remote location so that an embodiment can reproduce the performance in almost real time.

It is also envisioned that embodiments will be advantageous by offering a new platform to creatively express music in ways that have not been realized. For example, drive signals which have been distorted or filtered according to creative tastes will allow embodiments to produce new sound or new virtual instruments which never existed before.

CONCLUSION AND SCOPE

Thus the reader will see that at least one embodiment of the automated playback system provides a higher quality musical reproduction system that can be enjoyed by many.

While my above description contains many specificities, these should not be construed as limitations on the scope, but rather as an exemplification of embodiments thereof. Many other variations are possible. Accordingly, the scope should be determined not by the embodiments illustrated, but by the appended claims and their legal equivalents.

What is claimed is:

1. An automated playback system comprising:

a. a sounding body having an internal air column and a sleeve opening;

b. a piston nested within said sleeve opening, said piston having a transmitting surface in fluid communication with said internal air column;

c. an electro-dynamic actuator for providing motion to said piston;

d. a drive signal;

e. a signal means for providing said drive signal to said electro-dynamic actuator;

f. an electrically resistive heating element for heating said sounding body and said internal air column.

2. The automated playback system of claim 1 wherein said drive signal is related to a measurement of internal air column acoustic pressure of a wind musical instrument during play by a human player.

3. The automated playback system of claim 1 wherein said electro-dynamic actuator has an armature comprising:

a. a pipe-shaped portion having an electrical coil;

b. a ram portion being structurally joined with said pipe-shaped portion and said piston.

4. The automated playback system of claim 1 wherein a portion of said internal air column has a shape and size related to the shape and size of an internal air column of a wind musical instrument mouthpiece.

5. The automated playback system of claim 1 wherein said internal air column has shape and size related to the shape and size of an internal air column of a wind musical instrument.

6. The automated playback system of claim 1 wherein said piston is composed at least partially of Polytetrafluoroethylene (PTFE).

7. The automated playback system of claim 1 further comprising a microphone for providing a measurement of the acoustic pressure of said air column.

8. The automated playback system of claim 1 wherein said sleeve opening has a bearing surface for guiding the motion of said piston.

9. An automated playback system comprising:

a. a sounding body having an internal air column;

b. a piston having a transmitting surface in fluid communication with said internal air column;

c. an electro-dynamic actuator providing motion to said piston, said electro-dynamic actuator having an armature comprising:
   i. a pipe-shaped portion having an electrical coil;
   ii. a ram portion being structurally joined to said pipe-shaped portion and said piston;
d. a drive signal;
e. a signal means for providing said drive signal to said electro-dynamic actuator.

10. The automated playback system of claim 9 wherein said electro-dynamic actuator has a stationary portion and a moving portion, said stationary portion mounted to said sounding body for maintaining the position and alignment of said piston.

11. The automated playback system of claim 9 wherein said armature has at least one attached flexure for providing linear motion to said piston.

12. An automated playback system comprising:
a. a sounding body having an internal air column and a sleeve opening, said sleeve opening having a sleeve inner surface;
b. a piston nested within said sleeve opening, said piston having a transmitting surface in fluid communication with said internal air column, said piston having geometry producing a clearance between said piston and said sleeve inner surface sufficient to prevent contact between said piston and said sleeve inner surface;
c. an electro-dynamic actuator for providing motion to said piston;
d. a drive signal;
e. a signal means for providing said drive signal to said electro-dynamic actuator.

13. The automated playback system of claim 12 wherein said clearance has a clearance distance no greater than 0.5 millimeters.

14. The automated playback system of claim 12 wherein said electro-dynamic actuator has an armature comprising:
a. a pipe-shaped portion having an electrical coil;
b. a ram portion being structurally joined with said pipe-shaped portion and said piston.

15. The automated playback system of claim 12 wherein said electro-dynamic actuator has at least one attached flexure for providing linear motion to said piston.

* * * * *